US008928583B2

(12) United States Patent
Kogane

(10) Patent No.: US 8,928,583 B2
(45) Date of Patent: Jan. 6, 2015

(54) IMAGE DISPLAY CONTROL APPARATUS INCLUDING IMAGE SHOOTING UNIT

(75) Inventor: Takayuki Kogane, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 195 days.

(21) Appl. No.: 13/412,943

(22) Filed: Mar. 6, 2012

(65) Prior Publication Data

US 2012/0229373 A1 Sep. 13, 2012

(30) Foreign Application Priority Data

Mar. 8, 2011 (JP) ..... 2011-049725

(51) Int. Cl.
*G09G 5/00* (2006.01)
*G09G 5/36* (2006.01)

(52) U.S. Cl.
CPC ..... *G09G 5/36* (2013.01); *G09G 2320/0261* (2013.01); *G09G 2380/16* (2013.01)
USPC ..... 345/156

(58) Field of Classification Search
None
See application file for complete search history.

(56) References Cited

U.S. PATENT DOCUMENTS 8,421,901 B2 4/2013 In et al.
2006/0092292 A1* 5/2006 Matsuoka et al. ..... 348/231.99
2006/0136496 A1* 6/2006 Ohashi ..... 707/104.1
2009/0315869 A1 12/2009 Sugihara et al.
2010/0209074 A1 8/2010 Kondo et al.
2011/0293148 A1* 12/2011 Kobayashi ..... 382/107

FOREIGN PATENT DOCUMENTS

| | | |
|---|---|---|
| CN | 101828390 | 9/2010 |
| JP | 2002-118737 | 4/2002 |
| JP | 2009-141678 | 6/2009 |
| JP | 2010-004118 A | 1/2010 |
| JP | 2010-016432 A | 1/2010 |
| JP | 2010-169954 | 8/2010 |

OTHER PUBLICATIONS

Japanese Office Action dated Jul. 9, 2013 (and English translation thereof) in counterpart Japanese Application No. 2011-049725.
Chinese Office Action dated Dec. 26, 2013 (and English translation thereof) in counterpart Chinese Application No. 201210051710.8.

* cited by examiner

*Primary Examiner* — David D Davis
(74) *Attorney, Agent, or Firm* — Holtz, Holtz, Goodman & Chick PC

(57) ABSTRACT

An image display control apparatus includes a CPU performing face recognition within an image shot by a camera and detecting a gaze direction from a recognized face. The CPU then changes the image to a processed image at a predetermined rate in the case where at least one of the gazes of detected faces is directed to the displayed image.

11 Claims, 8 Drawing Sheets

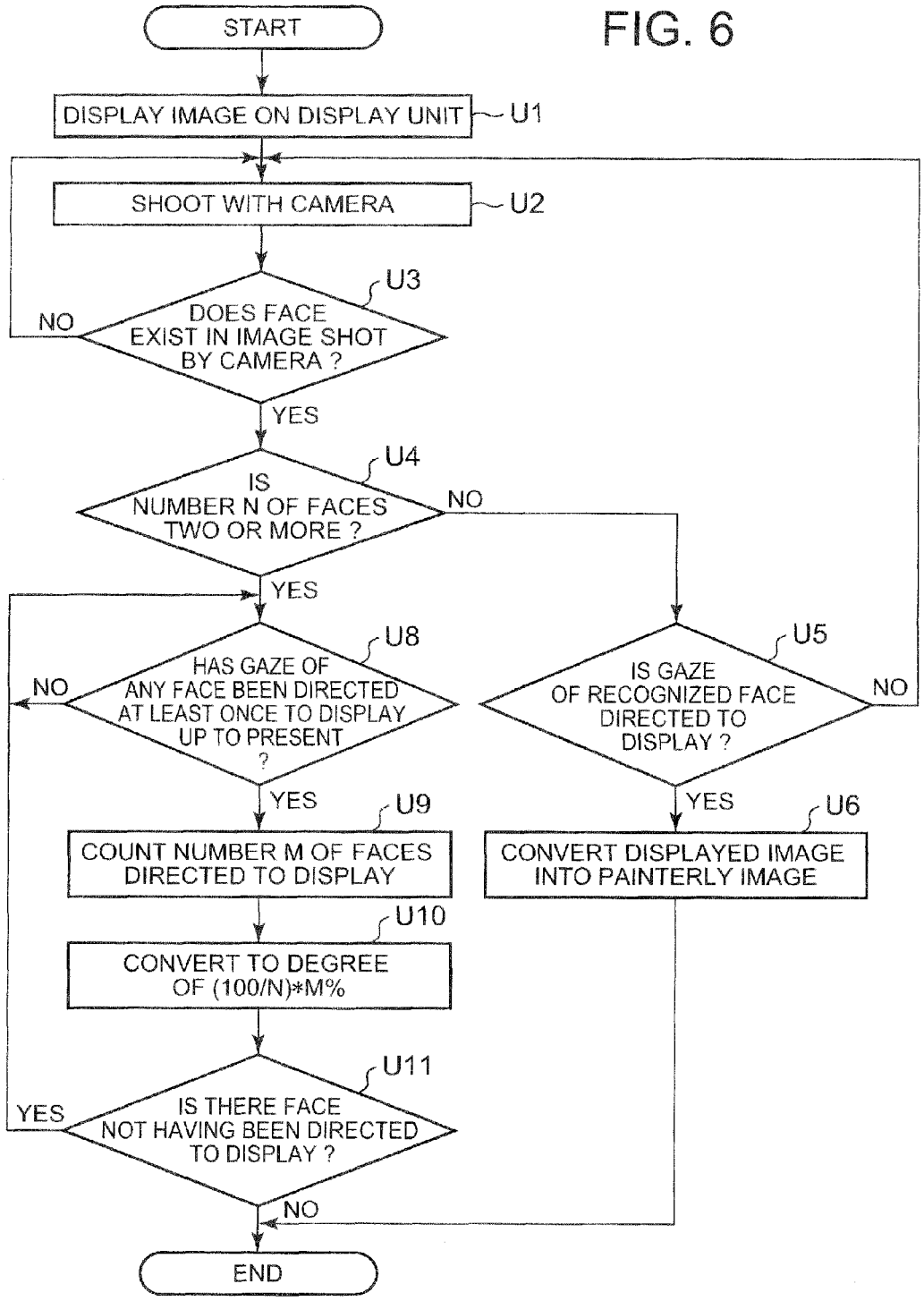
FIG. 6
START
DISPLAY IMAGE ON DISPLAY UNIT
U1
SHOOT WITH CAMERA
U2
U3
DOES FACE EXIST IN IMAGE SHOT BY CAMERA ?
NO
YES
U4
IS NUMBER N OF FACES TWO OR MORE ?
NO
YES
U8
HAS GAZE OF ANY FACE BEEN DIRECTED AT LEAST ONCE TO DISPLAY UP TO PRESENT ?
NO
YES
U5
IS GAZE OF RECOGNIZED FACE DIRECTED TO DISPLAY ?
NO
YES
U9
COUNT NUMBER M OF FACES DIRECTED TO DISPLAY
U6
CONVERT DISPLAYED IMAGE INTO PAINTERLY IMAGE
U10
CONVERT TO DEGREE OF (100/N)*M%
U11
IS THERE FACE NOT HAVING BEEN DIRECTED TO DISPLAY ?
YES
NO
END

IMAGE DISPLAY CONTROL APPARATUS INCLUDING IMAGE SHOOTING UNIT

BACKGROUND OF THE INVENTION

1. Field of the Invention

The present invention relates to an image display control apparatus and a storage medium.

2. Description of Related Art

Technology to switch an image display status depending on the status of a viewer of an image display apparatus is disclosed in Japanese Unexamined Patent Application Publication Nos. 2010-16432 and 2010-4118. Specifically, the technology disclosed in these patent publications switches the image display status between simplified rendering and detailed rendering depending on the viewer's status, including the distance from the viewer to the image display apparatus, the direction of the viewer's face, the gaze status, and the number of times of gazing.

SUMMARY OF THE INVENTION

An object of the present invention is to provide an image display control apparatus and a storage medium that prevent a viewer from missing an image change process.

According to an aspect of the present invention, there is provided an image display control apparatus including: an image storage unit that stores an image; an image display control unit that controls display of the image stored in the image storage unit; an image shooting unit that shoots an object on the side of a display surface; and a gaze-direction detector that performs face recognition within an image shot by the image shooting unit and detects a gaze direction from a recognized face, wherein, while at least one of gazes of respective faces detected by the gaze-direction detector is being directed to a displayed image, the image display control unit changes the displayed image to a processed image at a predetermined rate.

According to another aspect of the present invention, there is provided a computer readable storage medium having recorded thereon a computer program for controlling a computer that includes a display unit, an image storage unit that stores an image, and an image shooting unit that shoots an object on the side of a display surface of the display unit, wherein the program controls the computer to function as: an image display control unit that controls the display unit to display the image stored in the image storage unit; and a gaze-direction detector that performs face recognition within an image shot by the image shooting unit and detects a gaze direction from a recognized face, and wherein the program controls the computer so that, while at least one of gazes of respective faces detected by the gaze-direction detector is being directed to an image displayed on the display unit, the image display control unit changes the displayed image to a processed image at a predetermined rate.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 is a flow chart illustrating image display processing;

DESCRIPTION OF THE PREFERRED EMBODIMENTS

Embodiments of the present invention are described in detail below with reference to the attached drawings.

The scope of the invention, however, should not be limited to the embodiments.

First Embodiment

An image display control apparatus according to a first embodiment of the present invention is described below.

[External Configuration]

Figure 1:
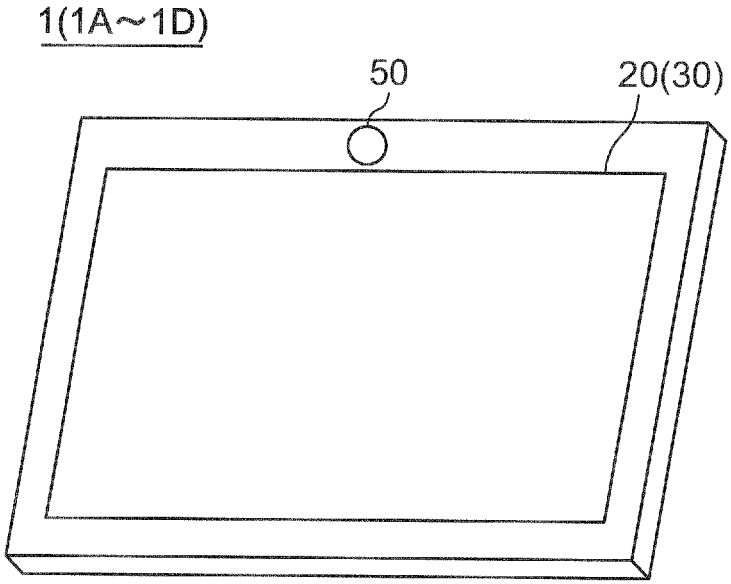
FIG. 1 is an external view illustrating a schematic configuration of an image display control apparatus.

FIG. 1 is an external view illustrating a schematic configuration of an image display control apparatus 1 in accordance with the present invention.

As shown in FIG. 1, the image display control apparatus 1 of the embodiment is a digital photo frame to be placed on a desk and is provided with a display 20 and a camera 50.

The display 20, which displays images and characters, is composed of a liquid crystal display (LCD) or an electroluminescent display (ELD).

The display 20 of the embodiment is integrated with a commonly-called touch panel 30 (refer to FIG. 2) and is ready to receive touch operations by a user.

The camera 50 is directed to the front of the display 20 (front direction or the side of the display surface) to shoot objects in front of the display surface.

The camera 50 herein is a known camera.

[Internal Configuration]

Subsequently, the internal configuration of the image display control apparatus 1 is described.

Figure 2:
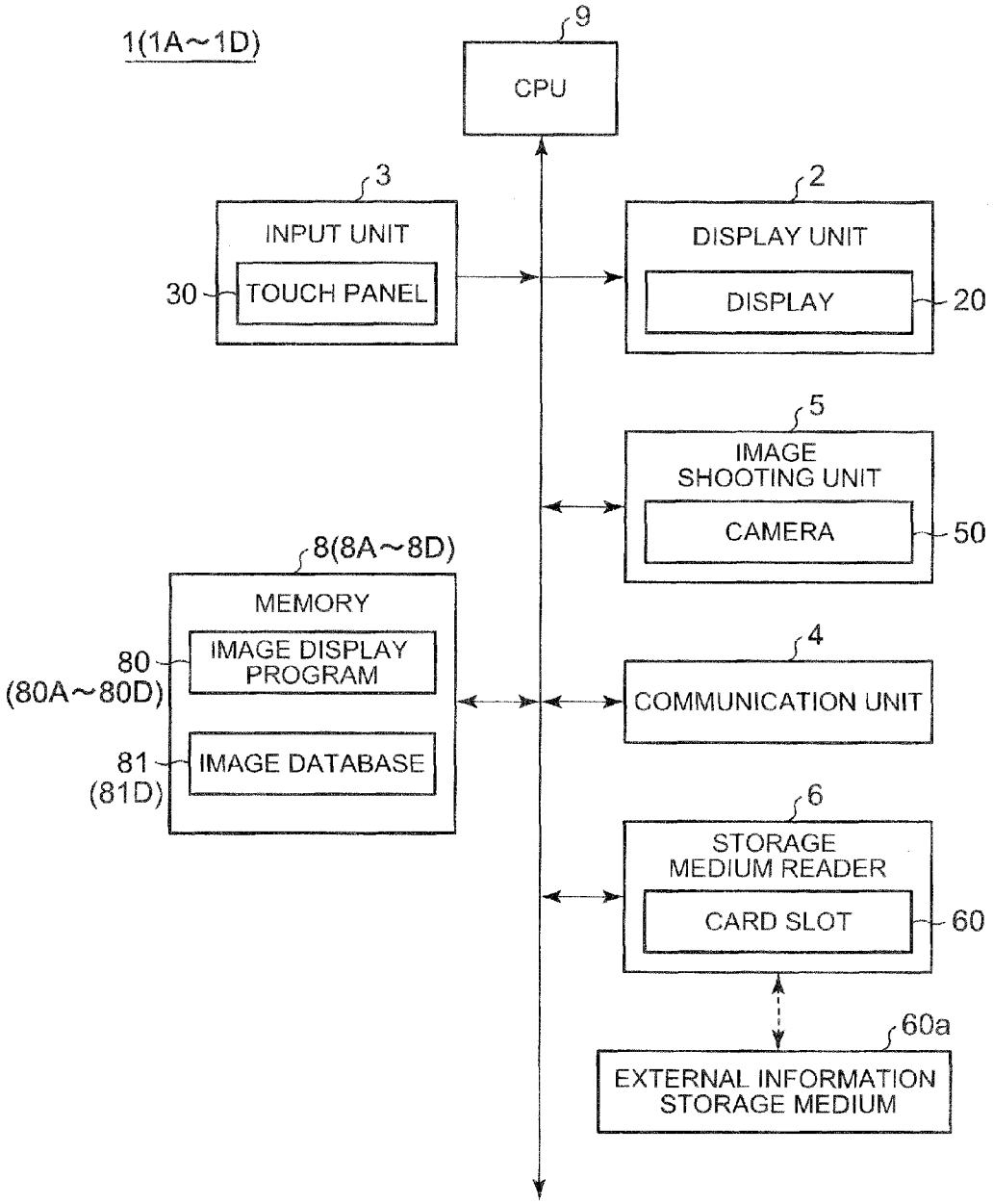
FIG. 2 is a block diagram illustrating a schematic configuration of the image display control apparatus.

FIG. 2 is a block diagram illustrating the internal configuration of the image display control apparatus 1.

As shown in FIG. 2, the image display control apparatus 1 includes a display unit 2, an input unit 3, a communication unit 4, an image shooting unit 5, a storage medium reader 6, a memory 8, and a CPU 9.

The display unit 2 has the display 20 and displays various pieces of information on the display 20 based on display signals received from the CPU 9.

The input unit 3 has the touch panel 30 and outputs, to the CPU 9, signals corresponding to a position pressed on the touch panel 30.

The communication unit 4 communicates data with another electronic device.

In the embodiment, the communication unit 4 transmits and receives information in the memory 8.

The image shooting unit 5 has the camera 50, which shoots an image based on image shooting signals received from the CPU 9.

The storage medium reader 6 has a card slot 60 and reads out information from an external information storage medium 60*a* placed in the card slot 60.

The storage medium reader 6 records information in the external information storage medium 60*a*.

The card slot 60 is not depicted in FIG. 1.

The memory 8 stores programs and data to perform a variety of functions in the image display control apparatus 1.

The memory 8 serves as a work area of the CPU 9.

In the embodiment, the memory 8 stores an image display program 80 according to the present invention and an image database 81.

The image display program 80 allows the CPU 9 to execute image display processing (refer to FIG. 3) described below.

The image database 81 stores image data of a plurality of images.

The image database 81 may be stored in the external information storage medium 60*a*.

The CPU 9 executes processing based on predetermined programs in response to input instructions.

Furthermore, the CPU 9 provides instructions and transfers data to individual functional units and comprehensively controls the image display control apparatus 1.

Specifically, the CPU 9 reads out a variety of programs stored in the memory 8 in response to operation signals from the input unit 3 and executes processing in accordance with the programs.

The CPU 9 then displays the results of the processing on the display unit 2 accordingly.

[Operation]

Subsequently, the image display processing performed in the image display control apparatus 1 is described with reference to FIG. 3.

In the image display processing, the CPU 9 displays, on the display 20, an image stored in the image database 81 (Step S1).

Then, the CPU 9 allows the camera 50 to shoot an image in front of the display 20 (Step S2).

The CPU 9 then performs face recognition within the shot image and determines whether or not a face of a viewer exists in front of the display 20 (Step S3).

If the CPU 9 determines that the face does not exist (Step S3: No), the process proceeds to Step S2 above.

Any known face recognition program may be used for the face recognition.

If the CPU 9 in Step S3 determines that the face of the viewer exists in front of the display 20 (Step S3: Yes), the CPU 9 detects a gaze direction of each recognized face.

Then, the CPU 9 determines whether or not at least one gaze is directed to the display 20 (Step S4).

If the CPU 9 determines that no gaze is directed (Step S4: No), the process proceeds to Step S2 above.

The term "one gaze" means that a gaze of one face.

Any known gaze detection program may be used for the detection of the gaze direction.

In the first embodiment and second through fifth embodiments described below, the gaze-direction determination is made by determining whether or not a gaze is directed to the display 20.

Figure 4A:
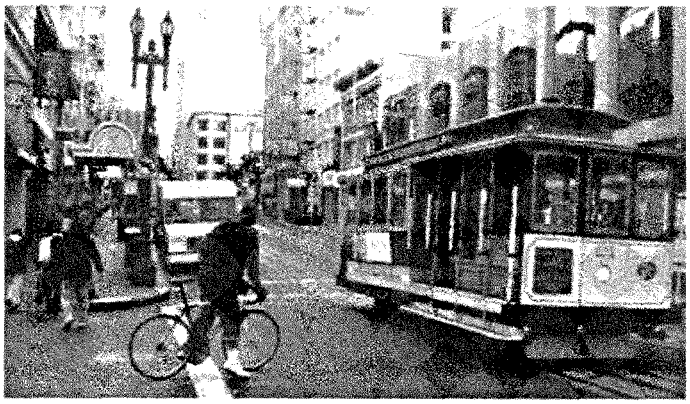
FIG. 4A illustrates an unprocessed original image.
Figure 4B:
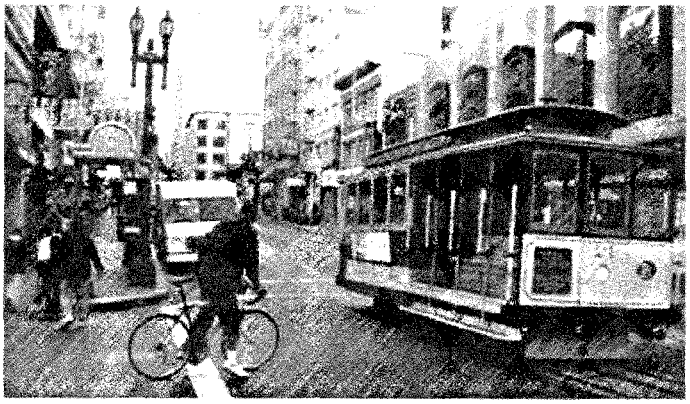
FIG. 4B illustrates an image being processed.
Figure 4C:
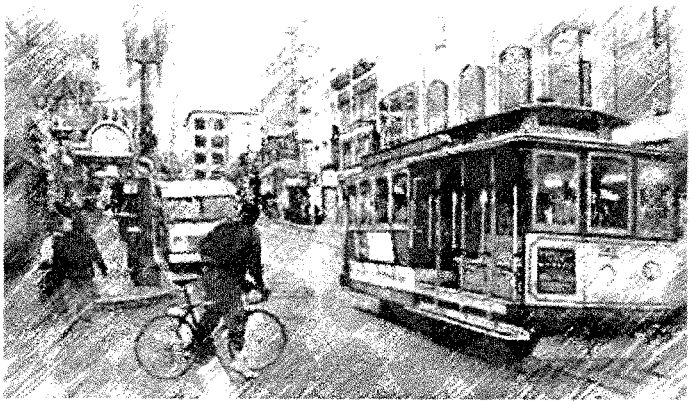
FIG. 4C illustrates a processed image.

In Step S4, if the CPU 9 determines that at least one gaze is directed to the display 20 (Step S4: Yes), the CPU 9 gradually changes the image displayed on the display 20 to a processed image at a predetermined rate, as sequentially shown in FIGS. 4A to 4C, for example (Step S5).

After a predetermined period of time elapses or after predetermined processing progresses, the CPU 9 determines whether or not the processing of the displayed image is completed (Step S6).

If the CPU 9 determines that the image processing is not completed (Step S6: No), the process proceeds to Step S4 above.

If the CPU 9 determines that the image processing is completed (Step S6: Yes), the image display processing ends.

Thus, the image displayed on the display 20 changes to the processed image at a predetermined rate while at least one gaze is being directed to the display 20.

Any known image processing program may be used for the image processing.

For such image processing, processing to convert an image into a painterly image may be employed.

The predetermined rate may be set so that one image is changed to the processed image for a period of several tens of seconds, for example.

To change the original image to the processed image at a predetermined rate, unprocessed and processed images may be cross-faded at a predetermined rate or the original image may be displayed while being processed at a predetermined rate.

Figure 3:
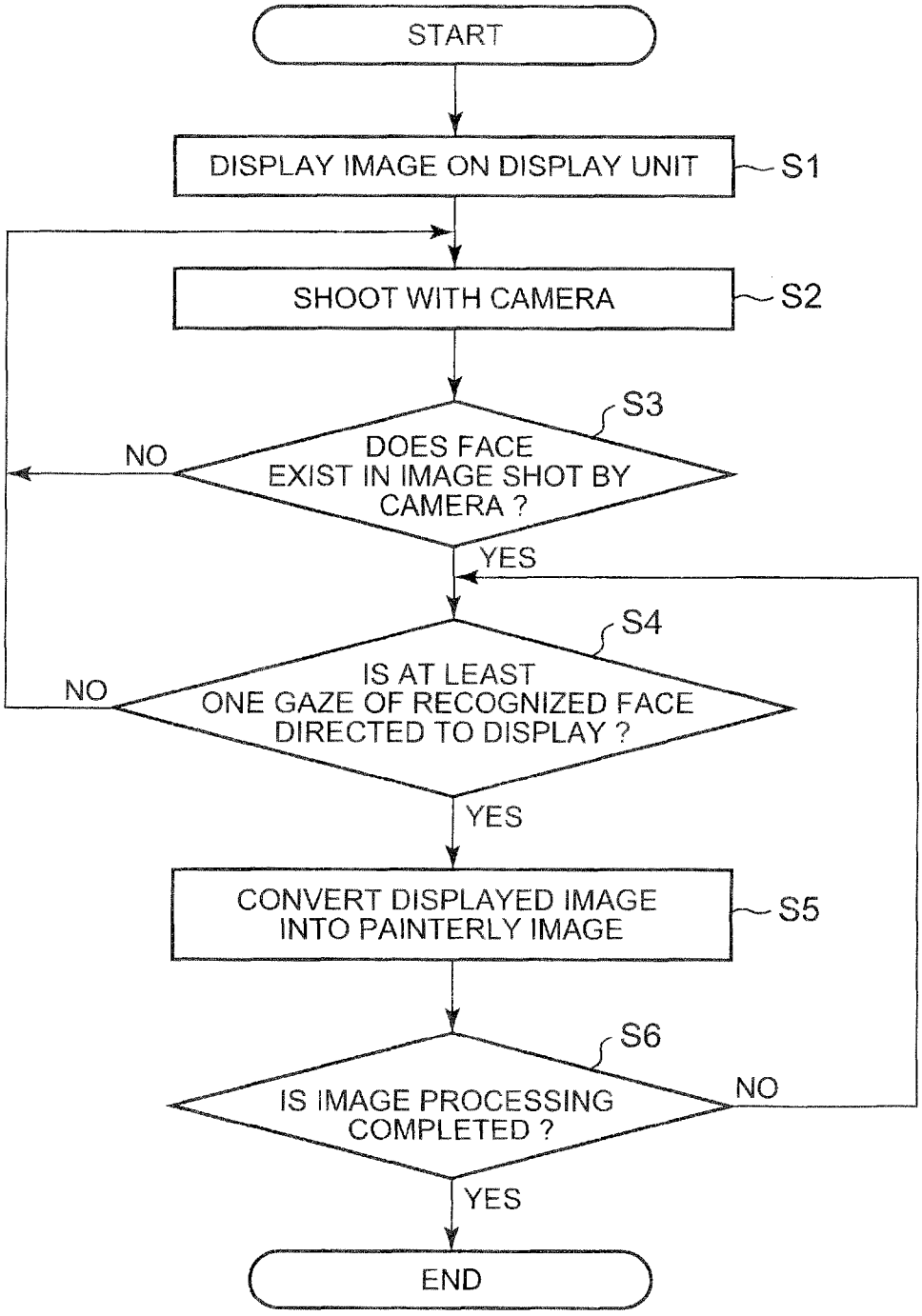
FIG. 3 is a flow chart illustrating image display processing.

As described above, the image display control apparatus 1 of the embodiment changes the image displayed on the display 20 to the processed image at a predetermined rate while at least one gaze is being directed to the display 20, as illustrated in Steps S4 and S5 in FIG. 3.

This prevents a viewer from missing the image change process.

Second Embodiment

Subsequently, an image display control apparatus according to a second embodiment of the present invention is described below.

Components corresponding to those in the first embodiment and similarly configured are denoted with the same reference numerals, and explanations of such components are omitted.

As shown in FIG. 2, the image display control apparatus 1A according to the embodiment has a memory 8A.

The memory 8A stores an image display program 80A according to the present invention.

The image display program 80A allows the CPU 9 to execute image display processing (refer to FIG. 5) described below.

Subsequently, the image display processing performed in the image display control apparatus 1A is described with reference to FIG. 5.

In the image display processing, the CPU 9 displays an image stored in the image database 81 on the display 20 (Step T1).

The CPU 9 then allows the camera 50 to shoot an image in front of the display 20 (Step T2).

The CPU 9 then performs face recognition within the shot image and determines whether or not a face of a viewer exists in front of the display 20 (Step T3).

If the CPU 9 determines that the face does not exist (Step T3: No), the process proceeds to Step T2 above.

If the CPU 9 in Step T3 determines that the face of the viewer exists in front of the display 20 (Step T3: Yes), the CPU 9 detects a gaze direction of each recognized face.

Then, the CPU 9 determines whether or not all the gazes are directed to the display 20 (Step T4).

If the CPU 9 determines that not all the gazes are directed (Step T4: No), the process proceeds to Step T2 above.

In Step T4, if the CPU 9 determines that all the gazes are directed to the display 20 (Step T4: Yes), the CPU 9 gradually changes the image displayed on the display 20 to a processed image at a predetermined rate (Step T5).

After a predetermined period of time elapses or after predetermined processing progresses, the CPU 9 determines whether or not the processing of the displayed image is completed (Step T6).

If the CPU 9 determines that the image processing is not completed (Step T6: No), the process proceeds to Step T4 above.

If the CPU 9 determines that the image processing is completed (Step T6: Yes), the image display processing ends.

Thus, the image displayed on the display 20 changes to the processed image at a predetermined rate while all the gazes of the respective faces detected with the camera 50 are being directed to the display 20.

Figure 5:
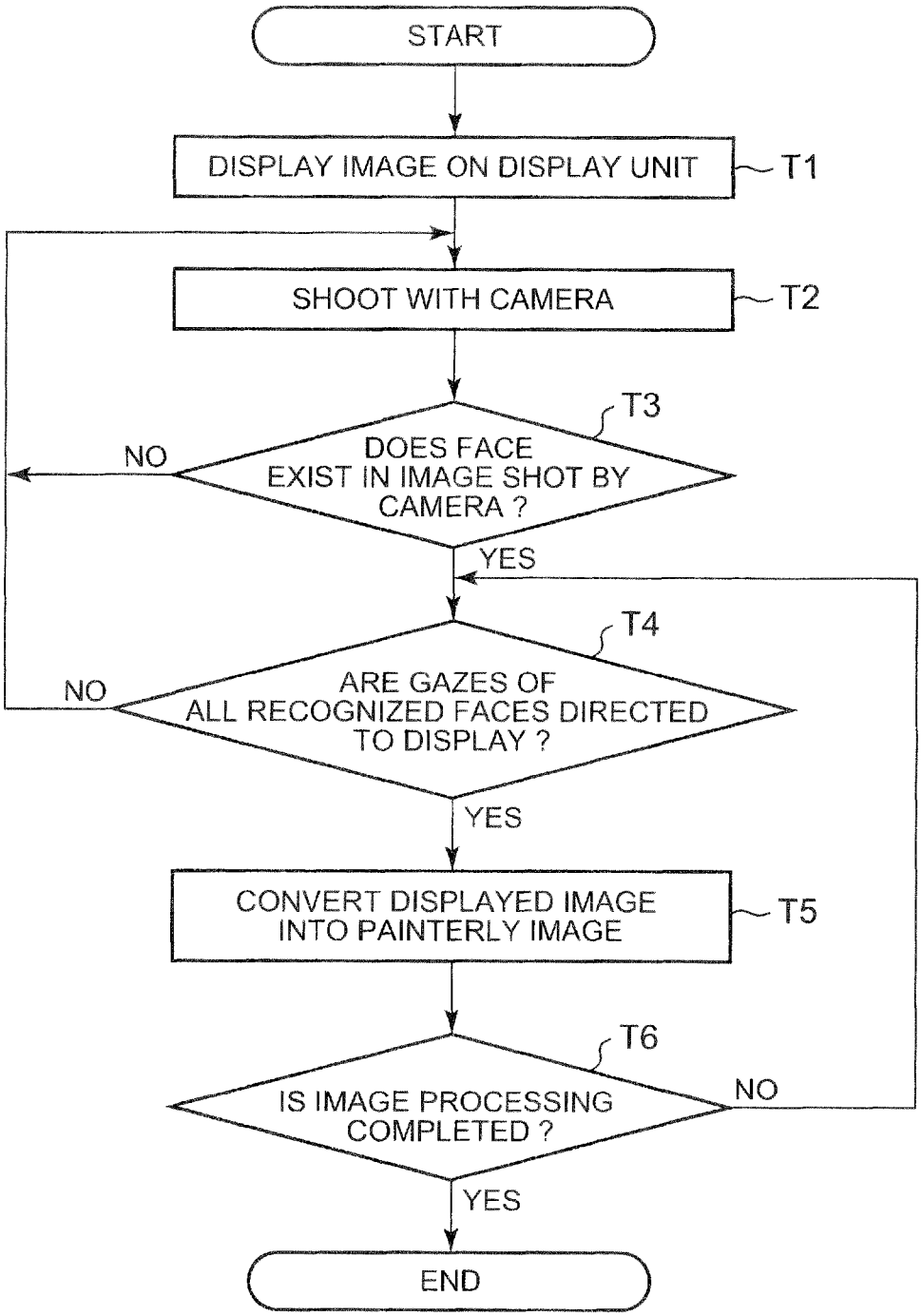
FIG. 5 is a flow chart illustrating image display processing.

As described above, the image display control apparatus 1A of the embodiment changes the image displayed on the display 20 to the processed image while all the gazes of the respective faces detected with the camera 50 are being directed to the display 20, as illustrated in Steps T4 and T5 in FIG. 5.

This prevents viewers from missing the image change process.

Third Embodiment

An image display control apparatus according to a third embodiment of the present invention is now described below.

Components corresponding to those in the embodiments above and similarly configured are denoted with the same reference numerals, and explanations of such components are omitted.

As shown in FIG. 2, the image display control apparatus 1B according to the embodiment has a memory 8B.

The memory 8B stores an image display program 80B according to the present invention.

The image display program 80B allows the CPU 9 to execute image display processing (refer to FIG. 6) described below.

Subsequently, the image display processing performed in the image display control apparatus 1B is described with reference to FIG. 6.

In the image display processing, the CPU 9 displays an image stored in the image database 81 on the display 20 (Step U1).

The CPU 9 then allows the camera 50 to shoot an image in front of the display 20 (Step U2).

The CPU 9 then performs face recognition within the shot image and determines whether or not a face of a viewer exists in front of the display 20 (Step U3).

If the CPU 9 determines that the face does not exist (Step U3: No), the process proceeds to Step U2 above.

If the CPU 9 in Step U3 determines that the face of the viewer exists in front of the display 20 (Step U3: Yes), the CPU 9 counts the number "N" (N is a natural number) of faces of viewers and determines whether or not N is two or more (Step U4).

If the CPU 9 in Step U4 determines that N is not two or more, that is, N is one (Step U4: No), the CPU 9 detects the gaze direction of the recognized face and determines whether or not the gaze is directed to the display 20 (Step U5).

If the CPU 9 determines that the gaze is not directed (Step U5: No), the process proceeds to Step U2 above.

If the CPU 9 determines that the gaze is directed to the display 20 (Step U5: Yes), the CPU 9 gradually changes the image displayed on the display 20 to a processed image at a predetermined rate (Step U6).

The CPU 9 then ends the image display processing.

In Step U4, if the CPU 9 determines that N is two or more (Step U4: Yes), the CPU 9 determines whether or not the gaze of any of the recognized faces has been directed at least once to the display 20 up to the present (Step U8).

If the CPU 9 determines that the gaze has not been directed (Step U8: No), the CPU 9 repeats Step U8.

In Step U8, if the CPU 9 determines that the gaze of any face has been directed at least once to the display 20 up to the present (Step U8: Yes), the CPU 9 counts the number "M" (M is a natural number) of faces whose gaze have at least once been directed to the display 20 up to the present (Step U9).

The number M is a net value, not a repeatedly counted value (accumulated value) for the same gaze.

Subsequently, the CPU 9 changes the image displayed on the display 20 to an image processed to the degree of 100× (M/N) % (Step U10).

The CPU 9 then determines whether or not there is still a face whose gaze has never been directed to the display 20 (M<N) (Step U11).

If the CPU 9 determines that there is still the face whose gaze has never been directed (Step U11: Yes), the process proceeds to Step U8 above.

If the CPU 9 determines that there is no face whose gaze has never been directed (Step U11: No), the image display processing ends.

As described above, the image display control apparatus 1B of the embodiment changes the displayed image to the image processed to the degree of M/N, where N is the number of faces detected with the camera 50 and M is the number of gazes directed at least once to the display 20 among the gaze directions of the respective faces detected with the camera 50, as illustrated in Step U10 in FIG. 6.

Thus, the image changes to the completely-processed image at a time when all the gazes are directed to the display 20.

This prevents viewers from missing the image change process.

Fourth Embodiment

An image display control apparatus according to a fourth embodiment of the present invention is now described below.

Components corresponding to those in the embodiments above and similarly configured are denoted with the same reference numerals, and explanations of such components are omitted.

As shown in FIG. 2, the image display control apparatus 1C according to the embodiment has a memory 8C.

The memory 8C stores an image display program 80C according to the present invention.

The image display program 80C allows the CPU 9 to execute image display processing (refer to FIG. 7) described below.

Subsequently, the image display processing performed in the image display control apparatus 1C is described with reference to FIG. 7.

In the image display processing, the CPU 9 displays an image stored in the image database 81 on the display 20 (Step V1).

The CPU 9 then allows the camera 50 to shoot an image in front of the display 20 (Step V2).

The CPU 9 then performs face recognition within the shot image and determines whether or not a face of a viewer exists in front of the display 20 (Step V3).

If the CPU 9 determines that the face does not exist (Step V3: No), the process proceeds to Step V2 above.

If the CPU 9 in Step V3 determines that the face of the viewer exists in front of the display 20 (Step V3: Yes), the CPU 9 counts the number "N" (N is a natural number) of faces of viewers.

The CPU 9 then determines whether or not N is two or more (Step V4).

If the CPU 9 in Step V4 determines that N is not two or more, that is, N is one (Step V4: No), the CPU 9 detects the gaze direction of the recognized face.

The CPU 9 then determines whether or not the gaze is directed to the display 20 (Step V5).

If the CPU 9 determines that the gaze is not directed (Step V5: No), the process proceeds to Step V2 above.

If the CPU 9 determines that the gaze is directed to the display 20 (Step V5: Yes), the CPU 9 gradually changes the image displayed on the display 20 to a processed image at a predetermined rate (Step V6).

The CPU 9 then ends the image display processing.

In Step V4, if the CPU 9 determines that N is two or more (Step V4: Yes), the CPU 9 changes the image displayed on the display 20 to a processed image at a predetermined rate (Step V8).

The CPU 9 then ends the image display processing.

As the predetermined rate in Step V8, the CPU 9 employs a rate calculated by (M/N)×V, where M (M is a natural number) is the number of gazes directed to the display 20 among the gaze directions of the respective faces detected in Step V3 and V is a reference rate of image change.

The reference rate V may be set so that one image is changed to the processed image for a period of one second, for example.

Then, the CPU 9 determines whether or not either value N or M changes (Step V9). If the CPU 9 determines that either value changes (Step V9: Yes), the process proceeds to Step V8 above.

If the CPU 9 determines that neither value changes (Step V9: No), the image display processing ends.

Figure 7:
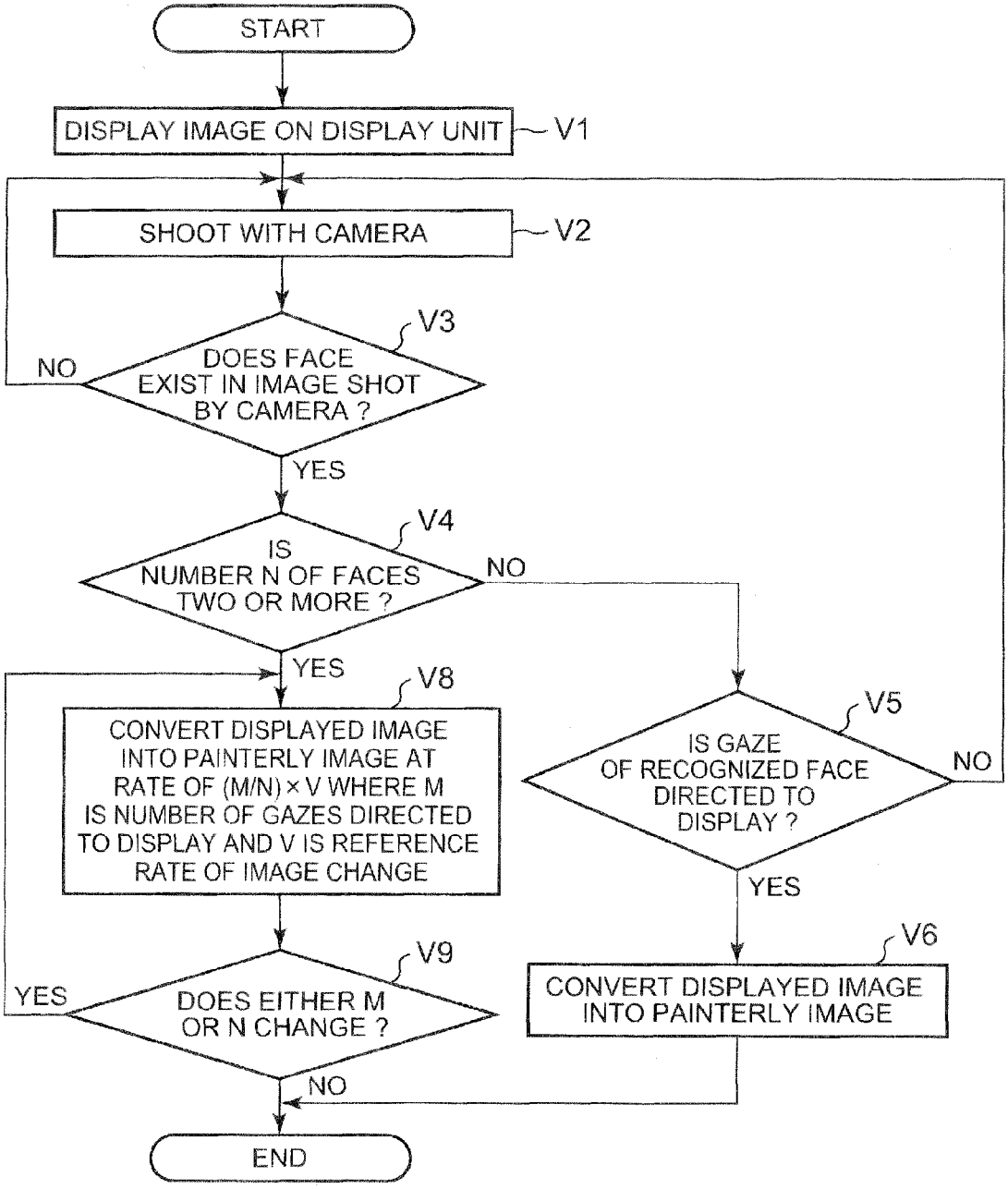
FIG. 7 is a flow chart illustrating image display processing.

As described above, the image display control apparatus 1C of the embodiment employs the rate calculated by (M/N)×V as the image change rate (predetermined rate), where N is the number of faces detected with the camera 50, M is the number of gazes directed to the display 20 among the gaze directions of the respective faces detected with the camera 50, and V is the reference rate of image change, as illustrated in Steps V8 and V9 in FIG. 7.

Thus, the image changes more slowly as the number of gazes directed to the display 20 decreases.

This surely prevents viewers from missing the image change process.

Fifth Embodiment

An image display control apparatus according to a fifth embodiment of the present invention is now described below.

Components corresponding to those in the embodiments above and similarly configured are denoted with the same reference numerals, and explanations of such components are omitted.

As shown in FIG. 2, the image display control apparatus 1D according to the embodiment has a memory 8D.

The memory 8D stores an image display program 80D according to the present invention and an image database 81D.

The image display program 80D allows the CPU 9 to execute image display processing (refer to FIG. 8) described below.

The image database 81D stores image data of each image with associated information about a face of a predetermined viewer of the image.

Examples of the predetermined viewer may include a person shot in the image, a person who shot the image, and an owner of the image.

The information about the face of the predetermined viewer may be data used in conventional face matching technology, such as a face image and characteristics of the face.

Subsequently, the image display processing performed in the image display control apparatus 1D is described with reference to FIG. 8.

In the image display processing, the CPU 9 displays an image stored in the image database 81 on the display 20 (Step W1).

The CPU 9 then allows the camera 50 to shoot an image in front of the display 20 (Step W2).

The CPU 9 then performs face recognition within the shot image and determines whether or not a face of a viewer exists in front of the display 20 (Step W3).

If the CPU 9 determines that the face does not exist (Step W3: No), the process proceeds to Step W2 above.

If the CPU 9 in Step W3 determines that the face of the viewer exists in front of the display 20 (Step W3: Yes), the CPU 9 detects the gaze direction from each recognized face.

The CPU 9 then determines whether or not the detected gaze is directed to the display 20 (Step W4).

If the CPU 9 determines that the gaze is not directed (Step W4: No), the process proceeds to Step W2 above.

If the CPU 9 in Step W4 determines that the gaze is directed to the display 20 (Step W4: Yes), the CPU 9 determines whether or not the face whose gaze is directed matches the information about the face of the predetermined viewer associated with image data of the displayed image (Step W5).

If the CPU 9 determines that the face does not match the information (Step W5: No), the image display processing ends.

If the CPU 9 in Step W5 determines that the face whose gaze is directed is the face of the predetermined viewer (Step W5: Yes), the CPU 9 gradually changes the image displayed on the display 20 to a processed image at a predetermined rate (Step W6).

After a predetermined period of time elapses or after predetermined processing progresses, the CPU 9 determines whether or not the processing of the displayed image is completed (Step W7).

If the CPU 9 determines that the image processing is not completed (Step W7: No), the process proceeds to Step W4 above.

If the CPU 9 determines that the image processing is completed (Step W7: Yes), the image display processing ends.

Thus, the image displayed on the display 20 gradually changes to the processed image at a predetermined rate in the case where at least one gaze is directed to the display 20 among the gazes of faces that are detected with the camera 50 and match information about faces of predetermined viewers.

Figure 8:
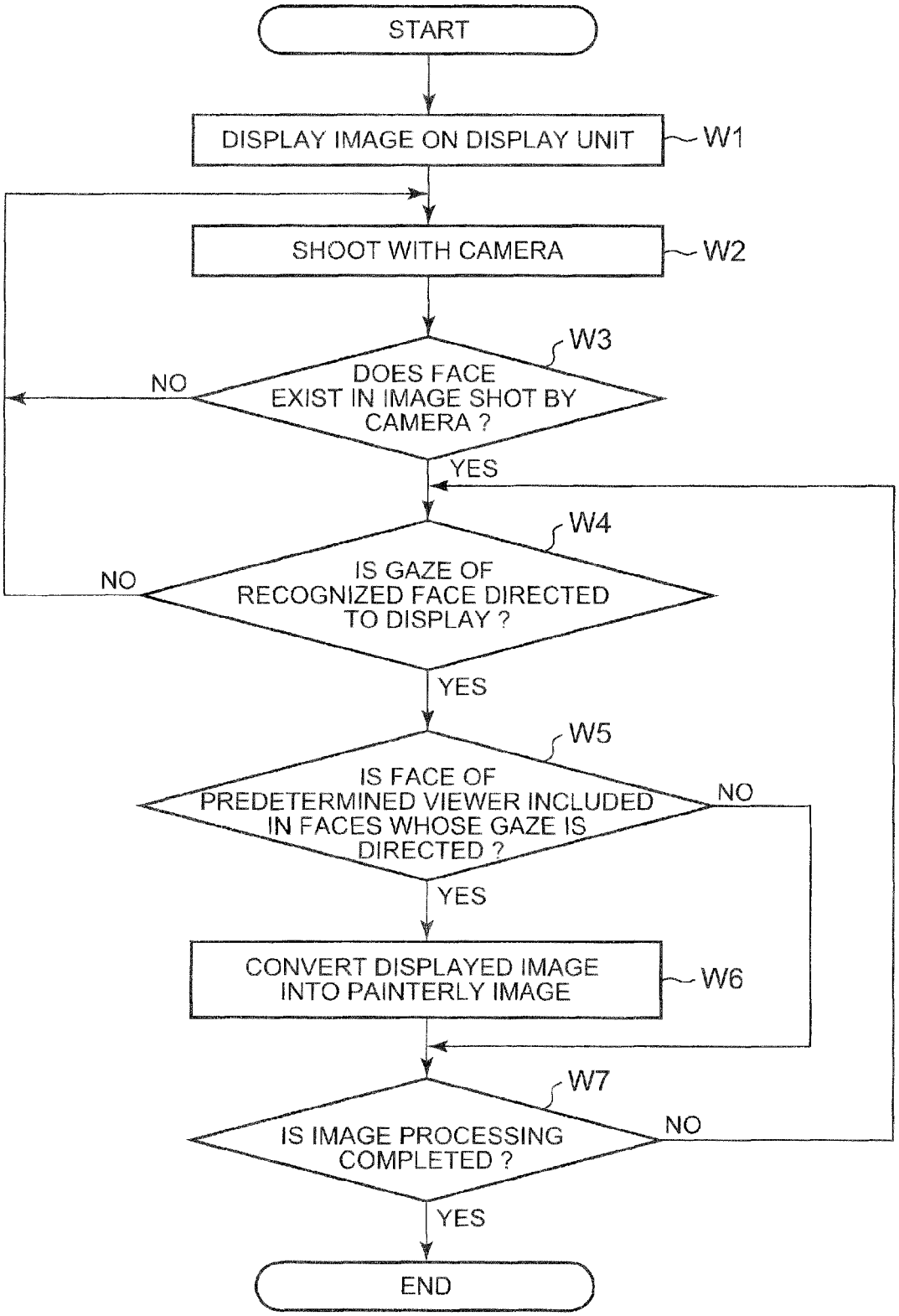
FIG. 8 is a flow chart illustrating image display processing.

As described above, the image display control apparatus 1D of the embodiment changes the image displayed on the display 20 to the processed image in the case where at least one gaze is directed to the display 20 among the gazes of faces that are detected with the camera 50 and match information about faces of predetermined viewers, as illustrated in Steps W5 and W6 in FIG. 8.

This prevents a previously-designated viewer from missing the image change process.

Detailed configurations and detailed operations of each component of the image display control apparatus 1 in the embodiments above may be modified appropriately without deviating from the concept of the invention.

For instance, the image display control apparatus of the present invention is described as a photo frame. The present invention, however, is not limited to such a product, but may be applicable to a variety of electronic devices, including mobile phones, personal computers, PDAs (personal digital assistants), and game machines. In this regard, the present invention is applicable to apparatuses having no display area thereon, such as, for example, a server connected to a monitor and a projector.

In this case, the camera 50 is disposed proximate to a screen or a monitor to shoot objects in a direction opposite to the display area.

The image display program 80 of the present invention may be stored in a memory card or a CD insertable to and removable from the image display control apparatus 1.

In the fifth embodiment, the information about the face of the predetermined viewer is associated with each image data. The information, however, may be stored in a database separate from the image data.

Some embodiments of the present invention are described above. The scope of the invention, however, is not limited to the embodiments above, but may also include the scope of the invention recited in the scope of the claims and its equivalents.

The entire disclosure of Japanese Patent Application No. 2011-049725 filed on Mar. 8, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image display control apparatus comprising:

an image storage unit that stores an image;

an image display control unit that controls display of the image stored in the image storage unit; and a gaze detector that is configured to detect a gaze of at least one person, wherein the image display control unit includes an image change unit that performs an image changing processing in which the displayed image is gradually changed over time to a processed image, wherein the displayed image gradually changes to the processed image from a change start time to a change end time, and wherein when a gaze of a person is detected by the gaze detector, the image change unit starts changing the displayed image to the processed image.

2. The image display control apparatus according to claim 1, further comprising a face recognition unit that is configured to recognize a face of at least one person, wherein the image change unit performs the image changing processing at a predetermined rate which is calculated by $(M/N)\times V$, where:

N is a number of faces detected by the face recognition unit,

M is a number of gazes detected by the gaze detector,

V is a reference rate of image change made by the image display control unit, and N and M are natural numbers.

3. The image display control apparatus according to claim 1, wherein, the image change unit performs the image changing processing to gradually change the displayed image to the processed image while the gaze of the person is detected by the gaze detector.

4. The image display control apparatus according to claim 1, further comprising a face recognition unit that is configured to recognize a face of at least one person, wherein the image display control unit changes the displayed image to the processed image to a degree of M/N, where:

N is a number of faces detected by the face recognition unit,

M is a number of gazes detected by the gaze detector, and

N and M are natural numbers.

5. The image display control apparatus according to claim 1, further comprising a face recognition unit that is configured to recognize a face of at least one person, wherein the image storage unit stores the displayed image with associated information about a predetermined viewer, wherein the image display control unit comprises a face determination unit that determines whether or not the face detected by the face recognition unit is a face of the predetermined viewer associated with the displayed image, and wherein when the face determination unit determines that the face detected by the face recognition unit is the face of the predetermined viewer associated with the displayed image, and while the gaze of the face of the predetermined viewer is detected by the gaze detector, the image change unit performs the image changing processing to gradually change the displayed image to the processed image.

6. The image display control apparatus according to claim 1, wherein the processed image processed by the image change unit is a painterly image.

7. The image display control apparatus according to claim 1, wherein when the gaze detector detects a plurality of gazes of persons, the image change unit performs the image changing processing to gradually change the displayed image to the processed image while all of the plurality of gazes of the persons are detected by the gaze detector.

8. The image display control apparatus according to claim 1, further comprising a face recognition unit that is configured to recognize a face of at least one person, wherein the image change unit starts changing the displayed image to the processed image when the gaze detector detects gazes of all faces recognized by the face recognition unit.

9. The image display control apparatus according to claim 1, wherein the image change unit stops changing the displayed image to the processed image before the change end time, when the gaze detector no longer detects the gaze.

10. A non-transitory computer-readable storage medium storing a program for controlling a computer that comprises an image storage unit that stores an image, the program causing the computer to perform functions comprising:

controlling display of the image stored in the image storage unit;

detecting a gaze of at least one person; and when a gaze of a person is detected, starting to perform an image changing processing in which the displayed image is gradually changed over time to a processed image, wherein the displayed image is gradually changed to the processed image from a change start time to a change end time.

11. An image display control method of an image display control apparatus which comprises an image storage unit that stores an image, the image display control method comprising:

controlling display of the image stored in the image storage unit;

detecting a gaze of at least one person; and when a gaze of a person is detected, starting to perform an image changing processing in which the displayed image is gradually changed over time to a processed image, wherein the displayed image is gradually changed to the processed image from a change start time to a change end time.

* * * * *